US006629030B2

(12) United States Patent
Klausner et al.

(10) Patent No.: US 6,629,030 B2
(45) Date of Patent: Sep. 30, 2003

(54) METHOD AND DEVICE FOR RECODING VEHICLE DATA

(75) Inventors: Markus Klausner, Pittsburgh, PA (US); Georg Pfaff, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/953,883

(22) Filed: Sep. 18, 2001

(65) Prior Publication Data

US 2002/0107619 A1 Aug. 8, 2002

(30) Foreign Application Priority Data

Sep. 21, 2000 (DE) ..... 100 46 696

(51) Int. Cl.[7] ..... G07C 5/08

(52) U.S. Cl. ..... 701/35; 340/438; 340/439; 369/21; 360/5

(58) Field of Search ..... 701/35; 340/438, 340/439; 369/21; 360/5

(56) References Cited

U.S. PATENT DOCUMENTS

| | | | | | |
|---|---|---|---|---|---|
| 4,987,541 | A | * | 1/1991 | Levente et al. | 701/35 |
| 5,388,045 | A | * | 2/1995 | Kamiya et al. | 701/35 |
| 5,412,570 | A | * | 5/1995 | Gruler et al. | 701/35 |
| 5,638,273 | A | * | 6/1997 | Coiner et al. | 701/35 |
| 5,997,171 | A | | 12/1999 | Talbott | |

FOREIGN PATENT DOCUMENTS

| | | | | | |
|---|---|---|---|---|---|
| DE | 195 09 711 | | | 9/1995 | |
| DE | 199 52 832 | | | 5/2000 | |
| EP | 0 078 807 | | | 5/1983 | |
| EP | 0596320 | A1 | * | 10/1993 | G01D/01/02 |
| JP | 06089399 | A | * | 3/1994 | G08G/01/00 |
| WO | WO 9310510 | A1 | * | 5/1993 | G07C/05/08 |

OTHER PUBLICATIONS

Wirtschaftswoche, No. 10, page 60 to 62, of Mar. 3,1989 ("Black Box im Auto") (Black Box in the Automobile).

* cited by examiner

*Primary Examiner*—William A. Cuchlinski, Jr.
*Assistant Examiner*—Eric M. Gibson
(74) *Attorney, Agent, or Firm*—Kenyon & Kenyon

(57) ABSTRACT

A method for recording data from parameter values captured using sensors in a vehicle, particularly for the reconstruction of accidents, as well as a memory device and a device for recording such data, it being possible to record all relevant data continuously using low memory volume, and to save it permanently in a short period of time. For this purpose, the parameter values and/or data calculated from them are recorded at increasing time intervals for the instantaneous capturing point in time at decreasing density. A suitable storage device has a RAM (random access memory) for recording the data in each case over a certain time space and in a nonvolatile memory (such as EEPROM), to which the recorded data can be transmitted in parallel from the RAM within a few ms. An ASIC is suitable for its implementation.

12 Claims, 2 Drawing Sheets

METHOD AND DEVICE FOR RECODING VEHICLE DATA

FIELD OF THE INVENTION

The present invention relates to a method and a device for recording data from parameter values captured or ascertained in a vehicle, particularly by using sensors, especially for reconstructing accidents, and to a storage device for recording such data.

BACKGROUND INFORMATION

For the purpose of ascertaining the course of an accident in vehicles having an antilock braking systems (ABS) it is known from European Patent No. EP 0 078 807 B1 store travel condition quantities such as vehicle speed, braking distance and braking deceleration captured by sensors and calculable, in order to reconstruct the accident from this, since vehicles having ABS mostly do not leave behind clear skid marks.

Accident data printers are introduced in an article in Wirtschaftswoche, No. 10, page 60 to 62, of Mar. 3, 1989 ("Black Box im Auto") (Black Box in the Automobile). The accident data printer is operated by sensors which pick up all the motion changes of the automobile. Additional data (such as light or blinker switch position, steering, pedal or clutch motions, etc) can be registered. All the data are stored on a chip and overwritten every 30 seconds with up-to-date data. In case of an accident, the chip's contents are frozen, and, until the automobile comes to a stop, further data are recorded. Finally, an accident data printer and a method of analyzing the occurrence of an accident are known from German Patent No. DE 195 09 711 A1. There, the attempt is made to minimize the great inaccuracy in determining accident data (speed and braking distance) by making use of GPS (Global Positioning System) signals for the evaluation, in addition to the data from the accident data printer. Hereby, a sufficiently exact relative position finding can be made, the absolute position finding (zero-point correction) being made by the known accident data printer. This document takes up the problem that, in order to obtain a sufficiently accurate calculation of the accident data using a customary accident data printer, an individual sensor would be required for each of the three translational and each of the three rotational degrees of freedom of the vehicle movement, which would result in an unacceptable computational and sensor-technical effort.

Actually, evidence on vehicle dynamics during an accident (mostly connected with abrupt braking, skidding or crash) requires capturing parameters at an interval such as 20–40 ms, and, for some parameters, such as wheel-speed, at less than 20 ms. On the assumption that 70 parameters are captured for accident reconstruction every 20 ms at a scope of 2 bytes over a time span of 30 ms, this would require a memory of 205 kByte.

The method described in German Patent No. DE 195 09 711 A1 for accident reconstruction, using GPS signals, requires a corresponding receiving system and likewise a substantial effort with respect to technical computations. Besides, retrofitting existing systems turns out to be difficult.

A further disadvantage of known accident printers is the long transmission time of data recorded in a volatile memory (RAM) to a non-volatile memory (e.g. EEROM). Typically, the RAM content is written into an EEPROM via a serial bus, such as the SPI. The transmission time grows linearly with the number of bytes to be transmitted. The slow transmission rate (e.g. 10 ms/byte) is unsuitable for transmitting the necessary volume of data for the actualization of an accident data memory functionality, after a crash in which there has been a probable collapse of the supply voltage as a result of damage to components of the vehicle's electrical system, or a specific disconnecting of the battery after detection of the accident.

Accident data printers are also known in which the corresponding data are not transmitted from a RAM to an EEPROM. For example, it is possible to configure the RAM battery-buffered, this actual construction being known in at least one commercially available accident data printer. However, in control equipment, battery-buffering is regarded as very unfavorable, since these do not have their own batteries, and the vehicle electrical system can break down during an accident. As was already mentioned, however, if data are to be transmitted in control equipment from a RAM to an EEPROM, a serial bus is frequently installed.

SUMMARY OF THE INVENTION

It is an object of the present invention to provide a method and a device for recording data from parameter values captured by means of sensors in a vehicle, particularly for the reconstruction of accidents, as well as a memory device for recording such data, it being possible to record all relevant data continuously using low memory volume, and to save it in a short period of time.

In addition, the present invention relates to a computer program, on a storage medium or data carrier, which, by being run on a computer or a control device executes a method according to the present invention. In this regard, the referenced storage medium can be permanently integrated into the computer or the control device, as, for instance, a RAM, E(E)PROM, flash EPROM, hard disk, etc., or it can be mobile, such as a diskette, CD-ROM or the like.

According to the present invention, the parameter values and/or data calculated from them are recorded at increasing time intervals at decreasing density for an instantaneous capturing point in time. For it has been shown that a high recording density is required in only a very short time space before an accident, since at that time high rates of change are probable in the parameter values. Values going back farther in time can be recorded at lesser resolution, since lower rates of change can be assumed, and the relevance of the data decreases with increasing time interval from the accident.

According to the present invention, the recording density can decrease, for example, exponentially, linearly or stepwise with increasing time interval from the instantaneous capturing point in time (that is, from the possible accident point in time). It is advantageous and easily feasible in practice to record the parameter values at discretely decreasing recording frequency, a suitable, predefined number of steps (such as 2 to 8, advantageously 3 to 6) being set to cover the recording time space.

In a particular embodiment of the method according to the present invention, representative data, such as extreme values or mean values are calculated from the captured parameter values and recorded. This is advantageous particularly when the data are recorded at a very low recording frequency. Then the information which has been lost because of the large interval in the recording points in time can be partially compensated. For example, the minimum value, the maximum value and the mean value of a parameter can be calculated between two recording times and stored. In this manner important data can be maintained, and yet fewer values can be recorded than if the recording frequency were at a maximum.

The method according to the present invention cannot only be applied to the reconstruction of vehicle accidents by the use of recorded data, but also, for example, for the evaluation of parts requirements, for the determination of the service life and/or the wear of individual parts, etc., provided that the parameters needed for this are measured or otherwise ascertained by the use of suitable sensors. The time period for recording and the timing of the recording frequency has to be established for each application and each parameter. For example, the data can be evaluated along the lines of when the exchange of a replacement part is indicated, judging from the stress up to the present.

It is advantageous for accident reconstruction if the recorded data are transmitted in parallel to a nonvolatile memory after a vehicle accident. The transmission time then no longer grows linearly with data volume, but rather, immediate storage is possible after an accident or a specific event.

Furthermore, the subject matter of the present invention is a memory device for recording data from parameter values captured by sensors in a vehicle, particularly for the reconstruction of accidents, a RAM (random access memory) for recording the data, each time for a certain time period, and a nonvolatile memory being installed, to which the recorded data from the RAM can be transmitted in parallel.

An accident can be recognized in various ways. Either the vehicle electrical system collapses because of damage to its components, or the accident is detected by sensor, special detection algorithms being used for this. In that case, it is necessary to save the recorded volume of data in a nonvolatile manner in as short a period of time as possible. In other applications too, it can be desirable to permanently save the recorded data immediately after a specific event.

For this purpose, according to the present invention, a so-called nvSRAM (nonvolatile static random access memory) is used. During normal operation, the SRAM replaces the RAM, and is connected in parallel to a nonvolatile memory (such as an EEPROM). The circuit is set in such a way that, if the supply voltage falls below a specified threshold value, or at the occurrence of a specified event, the entire SRAM content is saved in less than 10 ms.

Alternatively, any other storage technology can be applied, if it permits nonvolatile storage in brief time, e.g. in a few milliseconds (ms), of larger data volumes, e.g. several kilobytes (kbytes). Examples for this are FeRAM (ferroelectric RAM) and Flash-Banks (flash memory).

The use of an ASIC (application-specific integrated circuit) in the control unit of the vehicle is particularly suitable for the implementation of an accident data storage functionality in the vehicle. Many sensors do not communicate with the vehicle bus, but are connected to the control unit (directly or via the field bus). For this purpose, the control unit makes available sensor data over the bus. Thereby structures present anyway can be optimally used. The data supplied by the sensors are further used for accident reconstruction, the sensor data being available over the vehicle bus (e.g. CAN), and the desired data are evaluated using software. An ASIC is particularly advantageous when an nvSRAM is used for data storage. Simply fitting the control unit with the ASIC is required without further hardware changes; the required software changes are minimized. Selective outfitting with the accident data memory functionality is possible.

DETAILED DESCRIPTION

Figure 1:
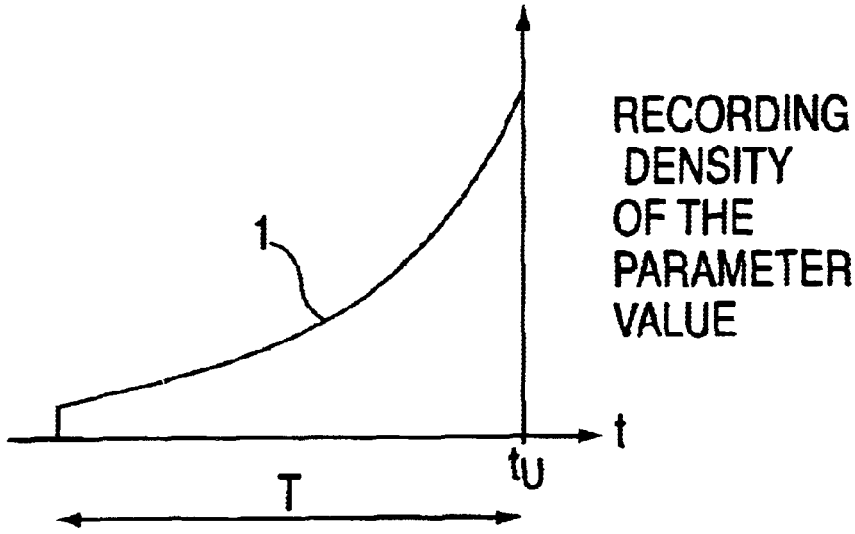
FIG. 1 shows a first Function 1, according to the present invention, on the decrease of the recording density of a parameter value with increasing interval in time to the instantaneous recording point in time.

In FIG. 1 the recording time space is denoted as T. T lies in the range of 60 seconds, for example, data being recorded a while longer for accident reconstruction after a crash detection, such as perhaps 5 to 10 seconds, before the entire memory content is saved, as far as this is possible in regard to the situation or the progression of the accident, respectively. Depending on the requirements, longer or shorter recording time spaces are also conceivable.

According to the present invention, the recording density decreases with growing distance in time to the time of the accident. Function 1 shows a nonlinear, essentially exponential pattern representing a continuous data compression.

Figure 2:
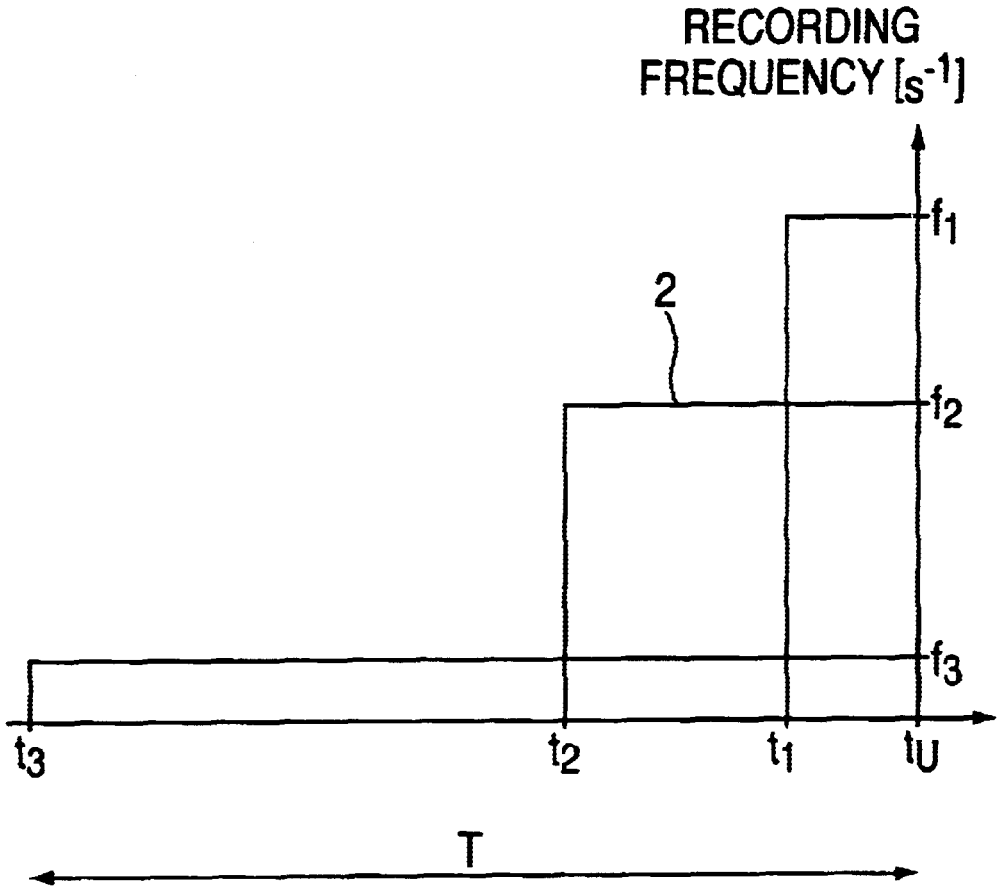
FIG. 2 shows a second Function 2, according to the present invention, on the decrease of the recording density of a parameter value with increasing interval in time to the instantaneous recording point in time.

Function 2 shown in FIG. 2 describes multistep, here three-step reduction of the recording density. The recording frequency is $f_1[s^{-1}]$ before the accident point in time $t_1$, before that, up to time $t_2$ it is $f_2$, and subsequently, up to time $t_3$ it is down to $f_3$. The constants $f_1$, $f_2$, $f_3$, $t_1$ and $t_3$ each have to be established parameter-specifically or arbitrarily predefined.

The savings E for the RAM and nonvolatile memory required for recording the parameters, as compared to the case of a non-changeable recording density, can be calculated as follows:

$$E = 1 - \frac{f_1(t_1 - t_u) + f_2(t_2 - t_1) + f_3(t_3 - t_2)}{f_1(t_3 - t_u)}$$

This formula (I) can be broadened to cover any arbitary number of steps.

In one particular kind of implementation, for time space t3 to t2, values of a parameter calculated from several intermediate values are recorded for each recording time, but this involves in total fewer values than with the use of a recording frequency of $f_2$. For example, the minimum value, the maximum value and the average value of the parameter can be stored between two recording points in time. Thereby the information lost because of the low recording frequency can be compensated for, at least in part. This makes particular sense when $f_1$ is very small, such as when $f_1$ is about 1 Hz. If b calculated values of a parameter are recorded for each recording point in time (in the above example, b=3) in the time period $t_2$ to $t_3$, the memory savings Eb are additionally, according to the following formula (II):

$$Eb = 1 - \frac{f_1(t_1 - t_u) + f_2(t_2 - t_1) + bf_3(t_3 - t_2)}{f_1(t_3 - t_u)}$$

For typical practical applications, memory savings of 80–90% can be achieved.

Figure 3:
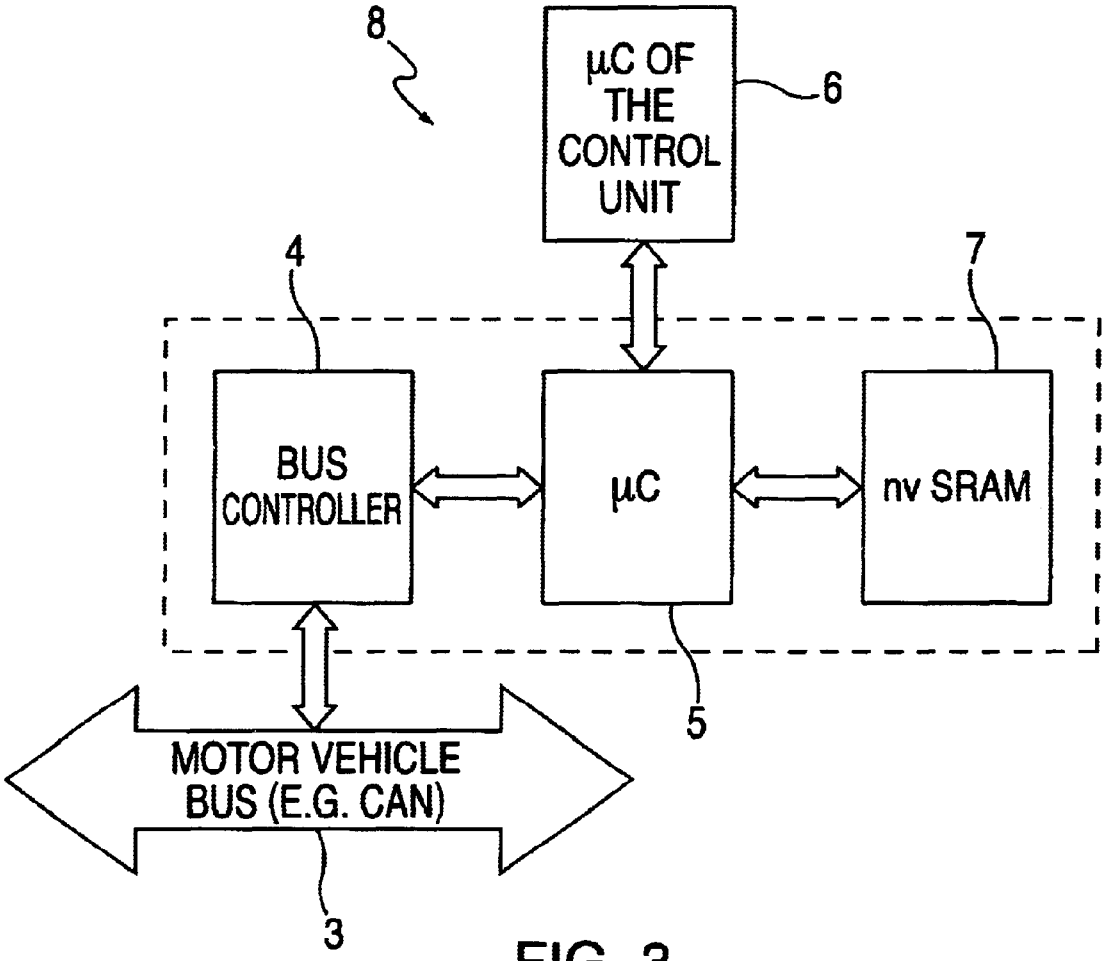
FIG. 3 shows the construction in principle of an ASIC 8 using an nvSRAM 7 for data storage for the accident reconstruction.

FIG. 3 schematically represents the construction of an ASIC 8 for the implementation of the accident storage functionality in a motor vehicle control unit. Sensors, not illustrated, pass on their signals via motor vehicle bus 3 (e.g.

CAN) to corresponding receiving devices, such as the control unit. For this purpose, microprocessor 5 of the ASIC, which communicates with motor vehicle bus 3 via bus controller 4, is connected to microprocessor 6 of the control unit. It should be noted here that the ASIC does not have to be provided with its own bus controller. But the use of its own bus controller is advantageous when the signals needed by the bus are different from the signals needed by the control unit into which the ASIC is integrated. According to the present invention, an nvSRAM 7 is provided, which records the parameter values relevant to accident reconstruction, particularly using the recording method according to the present invention, and saves them within a few ms during an accident. For this purpose, it is not necessary to fall back on discrete energy storage mechanisms, such as capacitors.

In a combination of the ASIC 8 represented in FIG. 3 with the use of the nvSRAM 7 and a recording density function according to the present invention, plenty of advantages can be achieved, compared to known accident data printers.

The requirement for RAM and nonvolatile memory (e.g. flash EEPROM) is significantly reduced as compared to the known ring storage principle having fixed recording frequency. This lowers the cost of the hardware. The described method permits acquiring a long history before the accident with increasing accuracy.

The problem of transmitting the entire RAM contents to the nonvolatile memory after omission of the supply voltage is solved by the present invention. In contrast to what is known, the entire data set is written in only a few ms in parallel (e.g. in an EEPROM) and it is no longer necessary to use discrete capacitors as energy storage mechanisms in the control unit.

Furthermore, through the use of an ASIC, it is of advantage that no changes are required in the hardware needed for the fulfillment of the control unit function. The software changes are minimized. The ASIC permits a selective implementation of the accident memory functionality due to the control unit's being outfitted with the ASIC.

The subject matter of the present invention is not, however, limited to the examples mentioned. Comparable solutions are likewise subsumed into the basic principle of the present invention of data recording using changeable density, measured at a time interval to the accident's point in time.

What is claimed is:

1. A method for recording data from parameter values determined in a vehicle, comprising:

recording, with decreasing density, at least one of (a) the parameter values and (b) data determined from the parameter values, with an increasing time interval from an instantaneous point in time at which the parameter values are determined; and transmitting the recorded data in parallel to a nonvolatile memory after a vehicle accident.

2. The method according to claim 1, further comprising recording the parameter values with a discreetly decreasing recording frequency.

3. The method according to claim 1, further comprising calculating and recording representative data from the parameter values, the representative data including at least one of extreme values and mean values, for recording intervals at a low recording frequency.

4. The method according to claim 1, further comprising using the recorded data for reconstructing a vehicle accident.

5. A storage device for recording data from parameter values determined in a vehicle, comprising:

a first storage medium for recording data in each case over a predetermined time period; and a second nonvolatile storage medium to which the recorded data from the first storage medium is transmitted in parrallel after a vehicle accident, wherein a recording density is variable, dependent upon a point in time at which the parameter values are determined.

6. The storage device according to claim 5, wherein the parameter values are determined for a reconstruction of a vehicle accident.

7. The storage device according to claim 5, wherein the first storage medium is a RAM.

8. The storage device according to claim 5, wherein the second storage medium is adapted to store at least a kilobyte of data in less than 10 milliseconds.

9. A vehicle control unit for recording data from parameter values determined by at least one sensor in a vehicle for reconstructing an accident, comprising:

an ASIC including an integrated storage device, the storage device including:

a first storage medium for recording data in each case over a predetermined time period; and a second nonvolatile storage medium to which the recorded data from the first storage medium is transmitted in parallel after a vehicle accident, wherein a recording density is variable, dependent upon a point in time at which the parameter values are determined.

10. A device for recording data from parameter values determined in a vehicle, comprising:

at least one storage medium for recording, with decreasing density, at least one of (a) the parameter values and (b) data determined from the parameter values, with an increasing time interval from an instantaneous point in time at which the parameter values are determined, wherein the recorded data is transferred in parallel to a non-volatile memory after a vehicle accident.

11. The device according to claim 10, wherein the recorded data is used for reconstructing a vehicle accident.

12. A storage medium storing a computer program which when executed by a processor performs the following:

recording, with decreasing density, at least one of (a) parameter values determined in a vehicle and (b) data determined from the parameter values, with an increasing time interval from an instantaneous point in time at which the parameter values are determined, wherein the recorded data is transferred in parallel to a nonvolatile memory after a vehicle accident.

* * * * *